United States Patent [19]

Clevinger

[11] Patent Number: 4,499,809

[45] Date of Patent: Feb. 19, 1985

[54] DUAL SIGNAL MAGNETIC PICKUP WITH EVEN RESPONSE OF STRINGS OF DIFFERENT DIAMETERS

[76] Inventor: Martin R. Clevinger, 5410 Telegraph Ave., Oakland, Calif. 94609

[21] Appl. No.: 512,219

[22] Filed: Jul. 11, 1983

Related U.S. Application Data

[63] Continuation-in-part of Ser. No. 360,181, Mar. 22, 1982, Pat. No. 4,408,513.

[51] Int. Cl.[3] ..... G10H 3/18

[52] U.S. Cl. ..... 84/1.15; 84/1.16

[58] Field of Search ..... 84/1.15, 1.16

[56] References Cited

U.S. PATENT DOCUMENTS 3,297,813 1/1967 Cookerly et al. ..... 84/1.16

*Primary Examiner*—S. J. Witkowski

[57] ABSTRACT

A transducer adapted to fretless musical instruments, instruments with non-conductive frets or non-conductive string wrapping, with two or more vibratable strings of magnetically permeable material. The strings pass through a magnetic field. Motion of the strings generates current in the strings. The magnetic field is provided by magnets shaped to concentrate the field across the signal generating portions of the strings. In a preferred embodiment, the coils are wound around the specially shaped magnets to utilize the same magnetic field used to generate current in the strings. Means are provided to passively mix both signals generated in the coil and signals generated in the strings. The circuitry electrically connected to the strings incorporates a method of balancing the uneven output caused by differences in string diameter. There is no special "return" wiring of the neck required. A wide variety of tonal differences are obtainable without active circuitry or signal processing. The signal level and impedance is such that it can be connected through a convenient length of cable to a standard musical instrument amplifier.

12 Claims, 7 Drawing Figures

DUAL SIGNAL MAGNETIC PICKUP WITH EVEN RESPONSE OF STRINGS OF DIFFERENT DIAMETERS

The present application is a continuation-in-part of my copending U.S. patent application Ser. No. 360,181, filed Mar. 22, 1982, and now U.S. Pat. No. 4,408,513, the subject matter of which is hereby incorporated by reference, and the benefit of the earlier filing date is hereby claimed for all common subject matter.

DESCRIPTION

1. Technical Field

The present invention relates generally to improved magnetic pickups for amplification of string musical instruments which are fretless or which have non-conductive, high resistance frets or non-conductive string wrappings. The invention involves two different methods of generating an audio signal within various magnetic circuits utilizing string transducers and sensing coils. The invention can be applied to any fretless string instrument having at least two magnetizable strings. Among such possible applications are the bass guitar, violin, viola, cello, and the double bass.

2. Background Art

Variable reluctance pickups of the prior art have become the established method of converting string motion into audio signals; the tonality and "touch response" of the electric bass are due largely to the characteristics of the pickup used. One major disadvantage of prior art variable reluctance pickups is found in those pickups having separate pole pieces or separate magnets dedicated to each string which results in small magnetic fields associated with each string. When the strings are plucked, their motion can exceed the area of the magnetic field, thus causing loss of signal.

When a string is plucked, the player first draws the string out of its restive position, then releases it. Acoustically, the initial attack furnishes a percussive quality and presence. Unfortunately, this initial acoustical vibration cannot typically be converted into an audio signal by conventional variable reluctance pickups. This is because the generation of an audio signal in response to the initial attack is delayed due to an opposition to current flow in the coil from the induced electromotive force being generated in the coil.

In prior art variable reluctance pickups, in order to passively drive a length of cable and to match the standard amplifier input impedance, as is required in normal operation of electric stringed instruments, the desired output level is achieved by using a coil having many turns of fine copper wire. The resulting coil has a high impedance. As a result, interference can more easily couple into the pickup signal path. Additionally, high frequencies are attenuated by the combination of this high impedance and the capacitance and inductance of the coils. Furthermore, the coils often have a resonance within the audio frequency range which cases frequency response peaks in the output signal. These characteristics combine to give a "tonal character" to the pickup. Efforts to reduce the high impedance of the coils, in order to increase their high frequency range or to equalize their response, have required the use of bulky and complex active circuitry in close association with the coils to amplify the signal levels before transmission to a musical instrument amplifier.

In spite of its disadvantages, however, the variable reluctance pickup is standard on electric basses. Almost all the music played employs electric basses equipped with variable reluctance pickups. These pickups provide clarity in T.V. and radio broadcasts, as well as in large concert halls. Representative of such variable reluctance pickups are those disclosed in U.S. Pat. No. 3,035,472 to Freeman; U.S. Pat. No. 3,066,567 to Kelley, Jr.; U.S. Pat. No. 3,147,332 to Fender; U.S. Pat. No. 3,571,483 to Davidson; U.S. Pat. No. 4,069,732 to Moskowitz, et al.; U.S. Pat. No. 4,133,243 to DiMarzio; U.S. Pat. No. 4,151,776 to Stich; U.S. Pat. No. 4,220,069 to Fender; and U.S. Pat. No. 4,222,301 to Valdez.

The electric bass has replaced the bass viol in most commercial music application because of its portability, playability, and audibility. However, many listeners, bassists, and arrangers realize the tonal quality of the electric bass is not as pleasing as that of the bass viols. Many electric bassists have switched from the fretted electric bass to the fretless electric bass to regain the expressive qualities only fretless instruments can afford the player. However, these efforts to regain such expressive qualities remain hindered by the limited range of tonal qualities offered by the variable reluctance pickups of the prior art.

Miessner, U.S. Pat. No. 1,915,858; Benioff, U.S. Pat. No. 2,239,985; Valsizch, U.S. Pat. No. 2,293,372; Cookerly, et al., U.S. Pat. Nos. 3,325,579 and 3,297,813; and Moskowitz, et al., U.S. Pat. No. 4,069,732 make use of currents magnetically induced in strings in fretted musical instruments. These configurations are also troubled by uneven string response levels and limited tonal range. In part, these problems were caused by the requirement for electrical return paths routed through the neck of the instrument in order to complete the string transducer circuit. These return paths tend to add additional impedance into the circuit and additionally act as antennas to introduce interference into the signal paths from stray fields. Furthermore, in certain of the prior configurations, the interaction between strings within the circuit tended to be in opposition to one another, rather than supportive thereof.

Moskowitz, U.S. Pat. No. 4,069,732 discusses the use of magnets which may be used in conjunction with variable reluctance pickups; however, the magnetic field strength is not of equal strength at the signal-generating portion of all strings. Thus, the strings closest to the magnetic sources produce louder outputs, causing an unbalanced output level among the different strings.

The present invention provides a pickup having the structure of the pickup disclosed in my above-mentioned application in which a wide variety of benefits are achieved, but with improved efficiency and economy of construction over that of the previously-mentioned application. Additionally, the present invention provides greater playing access to the strings, as the physical structures protruding from the instrument body are reduced in size.

SUMMARY OF THE INVENTION

The foregoing and other problems of prior art magnetic pickups are overcome by the present invention which provides first and second combinations of selected ones of the strings wherein the strings comprising each combination are selected so that the equivalent parameters of the first string combination are substantially similar to the equivalent parameters of the second string combination, the first and second string combinations being connectable in series or parallel. Magnetic source means are also provided which define magnetic poles positioned about the strings which are spaced apart but parallel to the string plane. The magnetic source means are shaped to have a reluctance air gap specific to the signal generating area occupied by the string which area is large enough to enable signal generation even in the case of maximum string excursion, occurring during musical performance. This concentrates the generated flux across the air gap which, in turn, enables the distribution of the magentic field in the specific signal generating areas of the strings, minimizes the physical size of the magnets and minimizes wasted or unusable field area. The magnetic field is thereby distributed only in the area required to generate audio signal. The free ends of the first and second string combinations are connected across the primary of step-up transformer means to provide an output signal of suitable impedance and magnitude at the secondary winding of the step-up transformer means.

In a preferred embodiment of the present invention, the magnets having U-shaped cross sections are utilized and may be partially recessed in holes provided in the instrument body. The provided holes act as stabilizing means for the magnets which can, themselves, have holes provided in their centers for insertion of mounting screws. Stout expansion springs can be spaced between the magnets and the bottom of the holes in the instrument body. As the mounting screws are loosened, the magnets are pushed toward the strings by the expansion springs. In accordance with my previous application, the magnetic pole surfaces, which are located at the top of each vertical leg of the U-shaped cross section, are disposed beside rather than under each string. The concentrated magnetic flux lines of the magnets are substantially oriented in a single direction and intersecting the strings at a right angle, thus enhancing the signal generating ability of the strings while substantially eliminating opposing current generation and attendant "out of phase" tonal quality. Additionally, the field passes through the strings with the same polar relationship for each string.

In a further embodiment of the present invention, it is envisioned that coils can be placed within this magnetic field for sensing variations of flux in the reluctance path, caused by string motion. The signals from these sensing coils can then be mixed with the signals from the secondary winding of the step-up transformer means. Conventional variable reluctance pickups can be used for the sensing coils. Alternatively, the sensing coils can be wound around the magnetic source means to utilize the same magnetic field, used in the string current transducer, in the sensing coil function.

Conventional variable reluctance pick-ups can be used without interference from the magnetic source means due to the concentrated nature of the field generated by the magnetic source means.

Any string motion causes a current to be induced within the variable reluctance pickup or coil sensor and another current to be induced within the strings themselves. These induced currents interact with one another by way of the series or parallel connection of the coil pickup with the secondary winding of the step-up transformer means. The result is a string current pickup with faster rise time and clearer definition for a new and distinctive tonality having more uniform signal levels from string to string and extended frequency response, over all degrees of string excursion.

The present invention therefore provides a unique pickup configuration which overcomes the uneven response characteristics of prior art pickups by balancing the characteristics of the strings as seen by the output circuitry in a string current transducer type pickup, and by providing magnetic source configuration having a uniquely distributed magnetic field.

The string current transducer portion of the present invention is not susceptable to limitations of conventional variable reluctance pickups and string current transducers previously mentioned. The coils of conventional variable reluctance pickups are often, of necessity, high impedance. The coils cannot be effectively shielded against interference and stray fields. The signal generating mechanism of the string current transducer portion is very low impedance, typically less than five ohms; thus, interference and stray fields do not couple well into the signal source. The secondary windings of the step-up or impedance matching transformers are higher impedance but can be effectively shielded against interference and stray fields.

It is envisioned that the present invention can include switchable impedance means for selection of a low or high output impedance secondary winding by way of coil tapping, for example.

The high frequency response of the string current transducer is better, and tonal character and touch sensitivity are closer to an acoustic instrument due in part to the fast rise time of the string current transducer, which in turn is due to the low inductance and reactance of the signal generating portion. In prior art variable reluctance pickups, the generation of an audio signal in response to the initial attack of a string is somewhat delayed due to an induced electro-magnetic force in the pickup coil. The faster rise time of the string current transducer gives the instrument greater definition and clarity; qualities which are desirable in ensemble playing or in playing in large rooms and under high ambient noise conditions.

The player can bend or draw the strings to the maximum possible tension and not suffer loss of signal. The signal generated in each string will correspond with the acoustic motion of that string even with extreme string motion because the magnetic field used to induce currents in the strings is distributed such that it will be present during all possible string motion. The output levels from each string are more uniform due to the matching of the strings among themselves and to the step-up transformer. In the preferred embodiment, the distributed magnetic field is obtained by way of distributed magnetic sources.

The magnetic field forms a reluctance pathway wide enough to include all dynamic levels of string actuation and large enough to be operatively associated with as much as one-eighth of the string length, the reluctance pathway being positioned preferably one-eighth of the string length from the bridge, thus producing a signal with a natural sounding harmonic content.

It is therefore an object of the present invention to provide a pickup which has greater dynamic range than prior art pickups and which is able to more faithfully respond to all string motion, including maximum excursions.

Another object of the invention is to provide a magnetic field source for generating electrical signals in the strings and in pickup coils, which maximizes efficiency by distributing the magetic field in the specific signal generating areas of the strings and which is compatible with prior art variable reluctance pickups.

A further object of the invention resides in the use of magnetic source means each of which is formed such that the magnetic flux is concentrated in a single reluctance gap, which is large enough to generate electrical signal even during the maximum string excursion, occurring during musical performance.

Yet another object of the invention is to provide magnetic source means for forming a distributed magnetic field operatively associated with the strings, which magnetic source means are formed to have a single reluctance gap, across which concentrated magnetic flux lines extend in substantially one direction. The flux lines intersect the strings at a right angle, thus, minimizing the generation of opposing or out of phase signals while increasing overall efficiency.

Still another object of the invention is to reduce the overall physical size of the magnetic source means to allow greater plucking access to the strings, while simplifying the construction of the magnetic source mounting means.

The above and other objectives, features and advantages of the invention will be more readily understood upon consideration of the following detailed description of certain preferred embodiments of the invention, taken in conjunction with the accompanying drawings.

FIG. *2a* illustrates the positioning of the sensing coils on one configuration of magnetic sources.

FIG. *2b* illustrates the positioning of a conventional variable reluctance pickup in the present invention, in addition to another configuration of magnetic sources.

FIGS. *3a* and *3c* illustrate two alternate magnetic source structures.

FIG. *3b* is an end view of the distribution of magnetic flux in magnets and strings.

Figure 4:
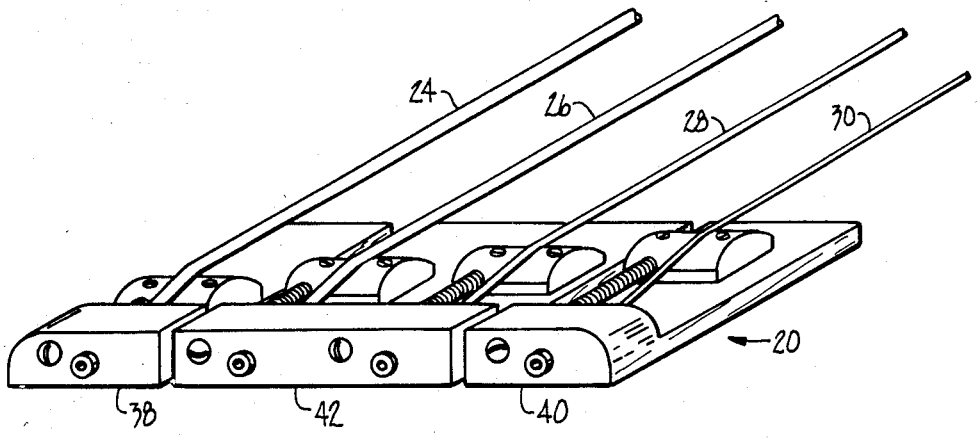
Figure 2A:
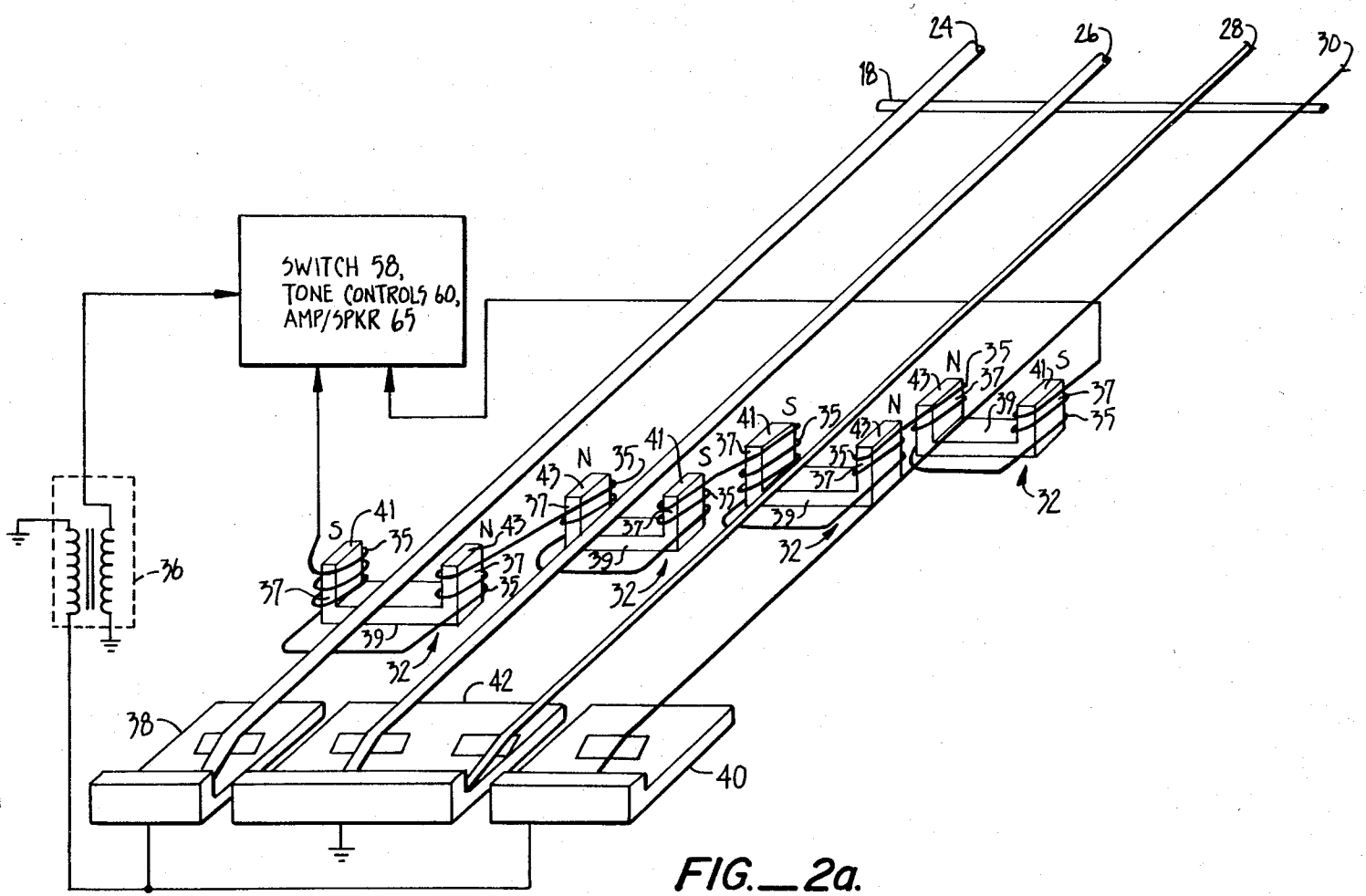
Figure 2B:
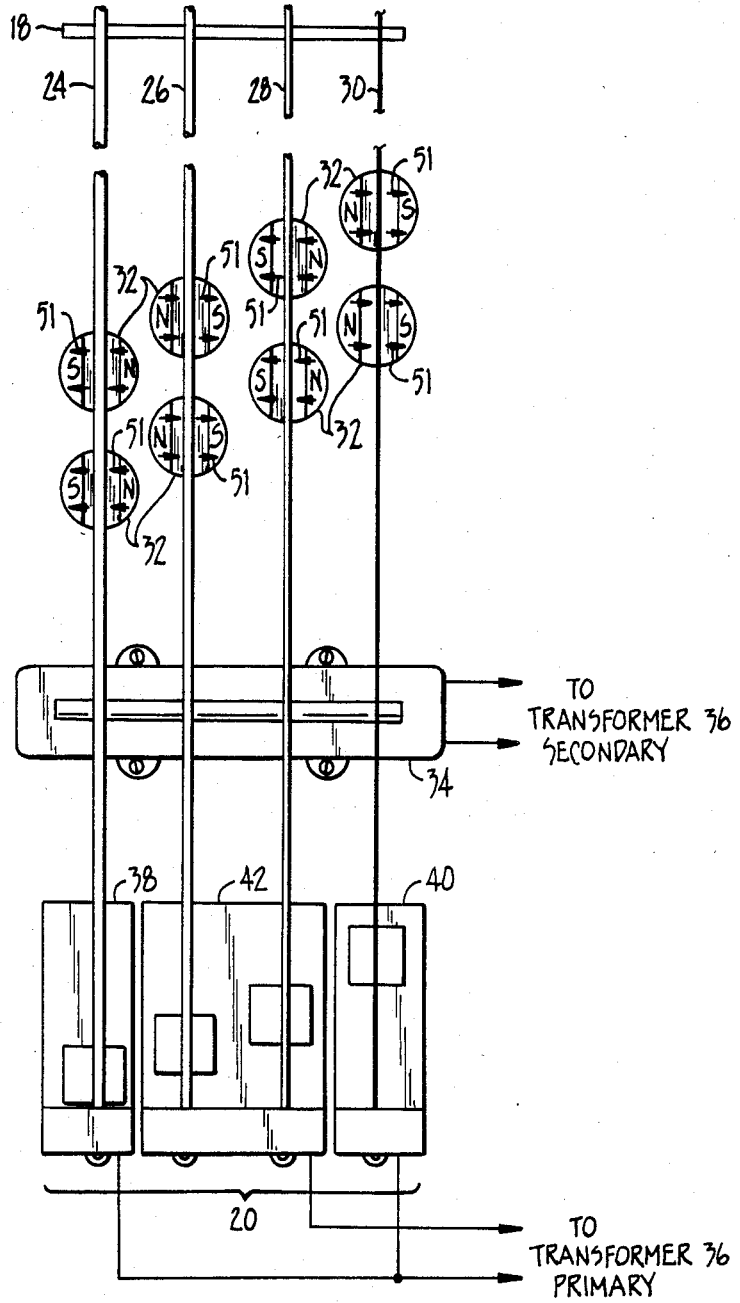
Figure 3A:
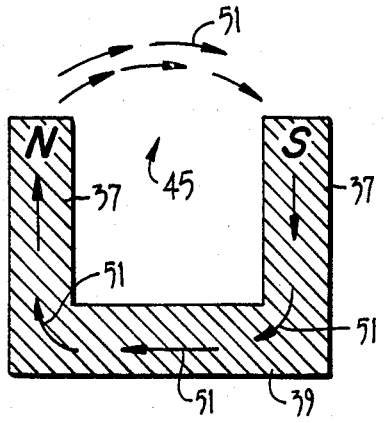
Figure 3C:
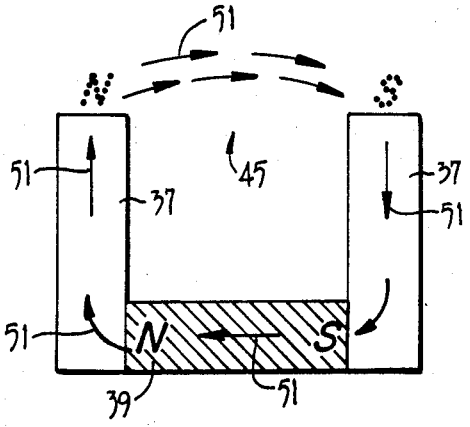
Figure 3B:
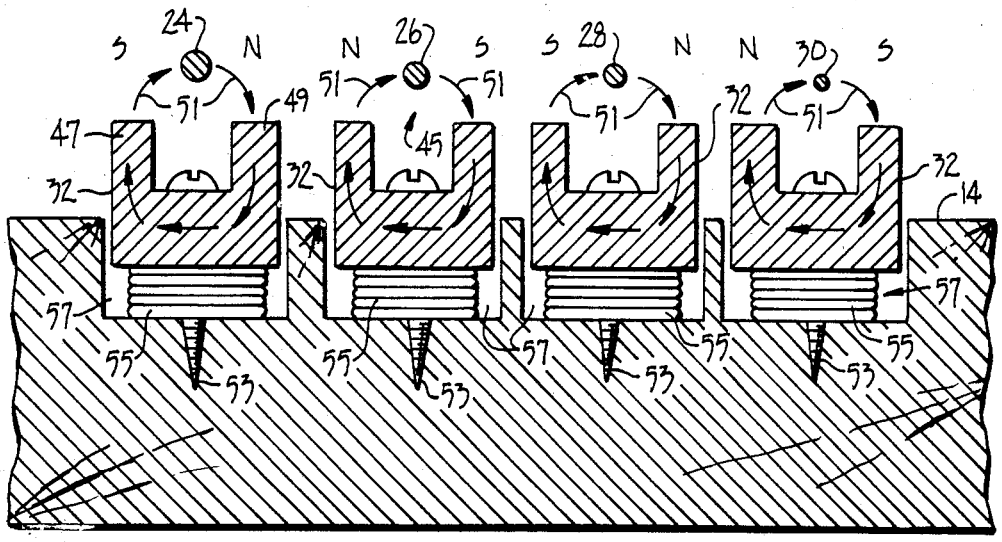

FIG. 4 illustrates the bridge assembly comprising three insulated sections.

DETAILED DESCRIPTION OF THE INVENTION

Figure 1:
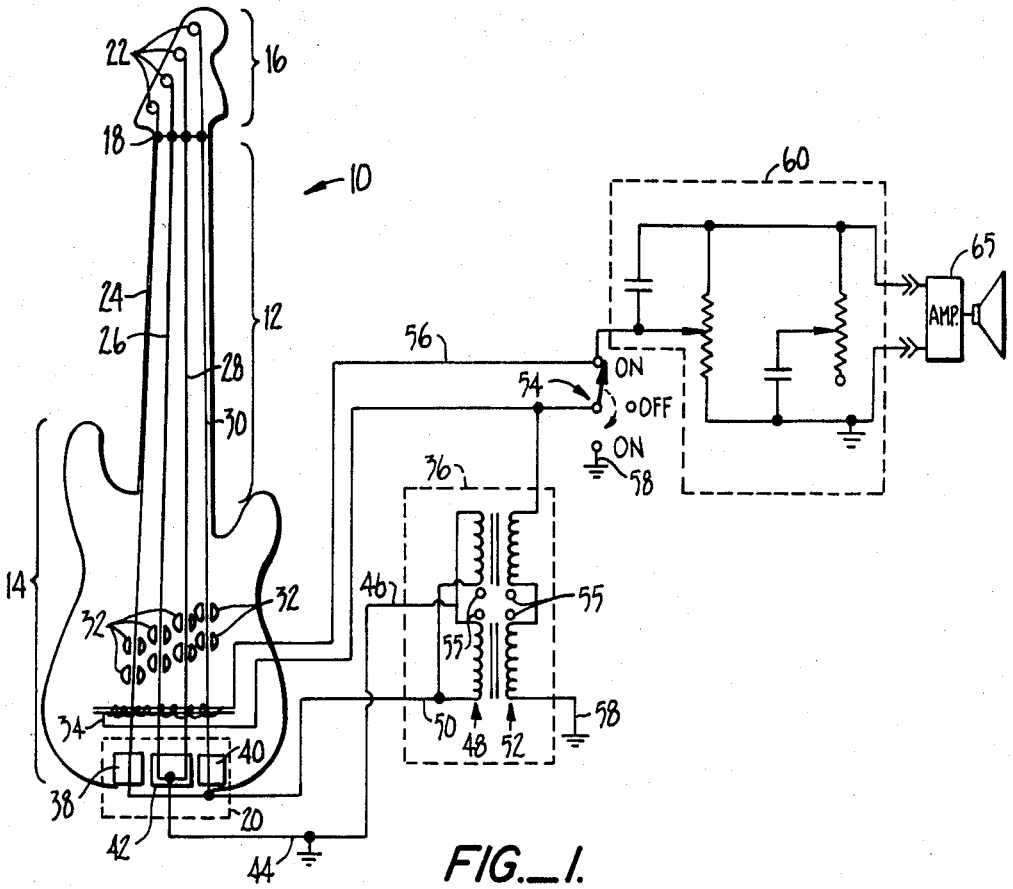
FIG. 1 illustrates the present invention as implemented in an electric, fretless, bass guitar.

Referring to FIG. 1, the present invention will be described by way of an illustrative example using a fretless electric bass guitar 10.

The bass guitar 10 includes a neck 12, a body 14, and a head 16. Four magnetically permeable strings are each tensioned over two permanent nodes. One of the nodes is a shorting bar 18 which is located at the junction of the head 16 and the neck 12. The other permanent node is the bridge 20 (enclosed by dotted lines). The strings are fixedly attached at bridge 20, and in movable contact with shorting bar 18. Adjusting pins 22 are provided in the head 16 by which the tension in each string can be adjusted.

The shorting bar 18 is electrically conductive and electrically connects all four strings together. The bridge 20 is comprised of several electrically isolated sections each of which is electrically conductive. This is to permit selected ones of the four strings to be electrically connected together.

The four strings are comprised of an E string 24, an A string 26, a D string 28 and a G string 30. These strings range from heaviest to lightest, respectively, with the E string 24 producing the lowest notes and the G string 30 producing the highest notes. Each of the strings has a different total mass, resistivity, coercivity, permeability, and reluctance. These properties affect the audio output obtained from each string; i.e., the thinner strings being more magnetizable and generating stronger audio signals than the thicker strings.

Disposed below, the strings are a plurality of magnets 32. These magents provide the magnetic field by which electrical currents are induced in response to string motion.

As discussed above, the bridge 20 is provided with a number of electrically isolated conductive sections which permit the interconnection of selected ones of the four strings. It is by way of this selective interconnection of such strings that the effects of the electrical differences between the strings are minimized and the audio response of each string is thereby made uniform.

In the illustrative example of the fretless electric bass 10, the previously mentioned differences between strings are minimized by the parallel connection of the heaviest E string 24 to the lightest G string 30. The A string 26 and the D string 28 are likewise connected in parallel. The parallel combination of the E string 24 and the G string 30 and the parallel combination of the A string 26 and the D string 28 are then connected in series via shorting bar 18. This series connection of the parallel combinations is then connected across a step-up transformer 36 (enclosed by dotted lines). Although the step-up transformer is shown in FIG. 1 as located outside of bass 10, it is to be understood that in practice, the step-up transformer 36, the switch 54 and tone control circuit 60 can be located in the body 14 of bass 10.

In order to effect the above parallel connections at the bridge 20, the E string is connected to an isolated conductive section 38, while the G string is connected to a different isolated conductive section 40. Conversely, the A string 26 and the D string 28 are both connected to the same isolated conductive section 42. See also FIG. 4. An electrical connection 44 is thereafter provided between isolated conductive section 42 and one end 46 of the primary winding 48 of the step-up transformer 36. Isolated conductive sections 38 and 40 are connected to the other terminal 50 of the primary winding 48 of step-up transformer 36.

By positioning step-up transformer 36 in close proximity to the bridge 20, the impedance of the electrical connections between the bridge and the primary winding 48, of the step-up transformer 36 can be kept small and the effect of such electrical connections on the performance of the pickup thereby minimized.

It should be noted at this point that due to the unique interconnection of the strings, there are no additional return or auxillary connections required between the strings and the output circuitry as was the case with numerous of the prior art pick-up configurations. Additionally, the serial connection of the two string combinations at the shorting bar 18 keeps the signal paths small and has been found to aid in the inducement of currents in the strings. Thus the conductive path of the string current transducer circuit is limited to the strings, the shorting bar 18 connection, the step-up transformer 36, and the bridge 20 connections.

It has been found that the interconnection of the strings in the configuration of strings of different diameters presents a more uniform load to the output circuitry, i.e. the step-up transformer. As a result, the audio output of each string matches the audio output of the other strings with respect to loudness, frequency response, and sensitivity. These qualities combine to make the instrument enjoyable to play and hear.

In the string bass example, the E and G strings are connected in parallel to form one string combination and the A and D strings are connected in parallel to form a second string combination. It has been found that for the electric string bass the above string combinations provide the best results. It is to be understood that the string combinations for different instrument types can differ. Therefore, for a particular instrument type selection of the particular strings to be included in each combination should be based upon which combination of strings provide the most similarity between the effective characteristics of each combination of strings.

U.S. Pat. No. 4,269,103 to Underwood and U.S. Pat. No. 3,177,283 to Fender appear to be directed to adjusting the response differences in strings of different types; however, these patents appear to be directed to signals generated in coil pick-ups, rather than by the strings themselves. U.S. Pat. No. 4,069,732 to Moskowitz appears to be directed to adjusting the differences in the output signals generated by the different strings; however, the technique employed by Moskowitz appears to utilize the concept of dissipating excess signal levels, rather than redistributing the string load as is the technique employed by the present invention. Apparently, Moskowitz uses shunting resistors in parallel with certain of the strings. This method is not desirable because, in addition to signal dissipation effects, these adjustments will have to be re-set each time new strings of a slightly different guage, type or brand are applied to the instrument. The shunting resistor also appears to load the signal generating circuit with resistance that is not part of the signal producing string, thus attenuating the overall signal output levels.

Returning to FIG. 1, the preferred embodiment of the step-up transformer 36 will now be described. Preferably, the primary winding 48 has a very low impedance, typically less than 5 ohms. Conversely, the secondary winding 52 has an output impedance which is selected to provide the standard output impedance required for typical musical instrument amplifiers, normally 10,000 ohms. The impedance of the secondary winding can be made to be either high or low impedance by the usual coil tapping arrangement. Furthermore, the high or low impedance state can be switchably selected by use of an appropriate switch, such as a double pole switch. As the name implies, the step-up transformer 36 acts to increase the signal level from the primary winding 48 to the secondary winding 52. Thus, in the high impedance example the turns ratio of the primary to the secondary is preferably very large, typically 1:90.

It has been found that commercially available step-up transformers do not presently provide, in a single transformer, the required low impedance primary winding. It has been discovered that connection of two transformers in the manner illustrated in FIG. 1 provides such a low impedance and, as an additional benefit, can be wired to greatly reduce spurious induced noise. As shown in FIG. 1, the primary winding 48 of the step-up transformer 36 is formed by connecting the primary windings of two step-up transformers in parallel. Conversely, the secondary windings of the step-up transformers are connected in series. In this manner, the effective primary winding impedance is reduced and the output signal from the secondary winding 52 is increased. As can be seen in FIG. 1, in order to reduce spurious noise, the secondary windings and the primary windings of the two step-up transformers are connected in an opposing polarity arrangement as indicated by the phasing dots 55. Thus the signal induced in the magnetic cores of the transformer are additive while any spurious signals induced in the coils will be cancelled. While the preferred embodiment of step-up transformer 36 involves parallel connection of two step-up transformers, it is to be understood that any step-up transformer which provides a very low impedance primary winding and a high impedance secondary winding and which further provides the required step-up ratio is satisfactory for the present invention. However, for best signal to noise ratio, such a transformer should have means for connection in the hum cancelling manner.

As can be seen from FIG. 1, a variable reluctance pickup 34 is connected in series with the secondary winding 52 of the step-up transformer 36. In this manner, the current induced within the pickup 34 and within the secondary winding 52 interact to produce a unique and musically pleasant audio output. It is envisioned that a series, i.e. single pole double throw, on-off-on, or parallel switch, such as a center-all-on telephone leaf switch such as manufactured by Switchcraft Incorporated of Chicago, Illinois, as is well known in the art, can be used as switch 54 to obtain a series connection of the signals or a parallel connection of the signals, respectively. When connected in series, the amplitude of the signal is increased and accompanied by an increase in inductance. This causes a high-frequency roll-off and a robust low frequency response. In the parallel connection the high frequencies remain intact and the overall clarity of the signal is enhanced, however the signal level is not increased. Alternatively, sensing coils 35 can be wound around the vertical legs of each of the magnetic structures 32, as shown in FIG. *2a*. In this manner, the magnets serve a dual purpose of supplying the magnetic field for inducing current flow in strings 24, 26, 28 and 30, as well as for inducing current flow in the sensing coils 35.

In the series-switch example, the wiper of a three-position switch is connected to the junction between sensing coils 35 (or variable reluctance pickup 34) and secondary winding 52. One terminal of the switch is connected to the free end 56 of the sensing coils 35 (or variable reluctance pick up 34), while another terminal of the switch is connected to the free end of secondary winding 52 via circuit common 58. The third terminal is left unconnected. In this manner, the wiper can be connected to bypass the output of the sensing coil 35 (or variable reluctance pickup 34) when only the output of the string current transducer is desired to be heard. Conversely, the wiper can be connected across the output of the secondary winding 52 to bypass the string current transducer signal whenever the sensing coil 35 (or variable reluctance pickup) signal alone is sought to be heard. When the contact is in the unconnected position, the outputs of both the sensing coil 35 (or variable reluctance pickup 34) and the string current transducer are combined to provide the audio output. These two outputs can be combined in the additive (in phase) or cancelling (out of phase) mode by appropriate switching (not shown). In the preferred embodiment, the outputs are connected in series, or the additive mode. The circuitry enclosed by dotted lines 60 are the conventional passive controls for use by the musician in shaping the signal before transmission to the amplifier. Double arrows 25 represent the co-axial cable connection between the bass guitar 10 and musical instrument amplifier 62. Typically, this co-axial cable connection can be fairly long, extending at least 20 feet. This long transmission distance has, in part, been responsible for the requirement of a fairly large output signal from magnetic pick-up means. As discussed above, it has sometimes been the case that preamplifiers within the electrical instrument itself were required in order to provide such output levels. In the case of the present invention, the circuit configuration provides sufficient output to passively transmit an audio signal through an appreciable length of cable.

Referring to FIGS. *2a, 2b* and *3a,* the structure and orientation of the magnets 32 with respect to sensing coil 34 and strings 24, 26, 38 and 30 will now be described in greater detail. In the preferred embodiment of the present invention, four to eight magnets are utilized. The magnets can be ceramic, alnico, or any other magnetic field source.

Each magnet has a U-shaped cross section. As can be seen from the figures each magnet has two spaced apart vertical portions 37 which are joined at one end by a horizontal section 39. One magnetic pole 41 is defined by the free end of one of the vertical portions, while an opposite magnetic pole 43 is defined by the free end of the other vertical section. With such a structure, substantially all of the magnetic flux generated by the magnet, which flows outside of the magnetic structure, is concentrated across the gap 45 which separates the free ends of the vertical portions of the structure. See FIGS. *3a* and *3c.*

The magnets can be of several general shapes. For example, FIG. *2a* illustrates a U-shaped structure constructed of rectangular portions. FIG. *2b* illustrates a top view of slotted cylindrical magnets 32. It is to be understood that there are numerous other configurations which provide the spaced-apart magnetic poles for the concentration of magnetic flux in the gap separating the poles in accordance with the present invention.

FIGS. *3a* and *3c* illustrate alternative structures by which the desired magnetic field characteristics can be achieved. The magnetic structure can be totally of permanent magnet material, as is shown in FIG. *3a.* There, the free end of one vertical section defines a north pole while the other free end defines a south pole. Conversely, the vertical portions 37 can comprise magnetically permeable material, such as a ferrite, and the horizontal portion 39 can comprise a permanent magnet, such as a bar magnet, FIG. *3c.* Preferably, the magnetically permeable material is of sufficient permeability so that substantially all of the magnetic flux from the permanent magnet 39 flows within the vertical portions 37. As such, magnetic poles will be defined at the free ends of the vertical portions as indicated in FIG. *3a.*

FIG. *3b* illustrates the preferred positioning of the magnets 32 with respect to the strings. As discussed above, a plurality of magnets are provided, with each magnet 32 being positioned beneath an associated string. For example, in FIG. *3b,* it can be seen that string 24 is positioned above magnet 32 so that one of the magnetic poles 47 is located below and to one side of string 24, while the other magnetic pole 47 is positioned below and to the opposite side of string 24. The result is that string 24 is positioned centrally within the region of greatest magnetic flux concentration, and at right angles to the flux path. See FIG. *2b.* This maximizes the magnitude of the current induced in string 24, and ensures that a magnetic field of sufficient magnitude will impinge upon the string 24 for substantially all string excursions.

In FIGS. *3a, 3b,* and *3c* Arrows 51 illustrate the flux paths both inside and outside of the magnetic structures. Thus, it can be seen that the magnetic flux generated by any one magnetic structure 32 is concentrated in a localized area. As such, interference between magnetic structures, caused by stray fields, and between a magnetic structure and a separate variable reluctance pickup, is minimized.

FIG. *3b* also illustrates a screw and bias-spring configuration which permits the magnetic structures 32 to be adjusted individually with respect to their associated strings. Preferably, the magnetic structure 32 will be tapped to permit a screw 53 to be inserted therethrough and into the body 14 of the instrument. A bias spring 55 is positioned between the bottom of the magnetic structure 32 and the body 14. Bias spring 55 maintains a tension between the body 14 and magnetic structure 32 to keep magnetic structure 32 firmly in place over the range of height adjustments permitted by screw 53. FIG. *3b* also illustrates the use of recesses 57 within body 14 in which the bias spring 55 and magnetic structure 32 can be mounted. These recesses act to stabilize the position of the magnetic structure 32 as well as permit a lower overall profile of the magnets above the top of the body 14.

In the preferred embodiment of the present invention, adjacent magnets are positioned with respect to one another so that like poles for each magnet face each other. This minimizes the magnetic coupling between magnet structures 32 associated with different strings. This preferred positioning is illustrated in FIGS. *2a, 2b* and *3b.*

Returning to FIGS. *2a* and *2b,* the use of sensing coil 35 or a variable reluctance pickup 34 in the present invention will now be discussed in greater detail. FIG. *2a* illustrates the use of a sensing coil 35 which is wound around the magnetic structures 32 of the present invention. Here the magnetic structures provide the magnetic field for both the string transducer portion of the invention as well as the sensing coil portion of the present invention. Preferably, for each magnetic structure 32, sensing coil 35 is wound around the vertical portion, corresponding to one magnetic pole, in a direction which is opposite that in which it is wound for the vertical portion defining the other magnetic pole of the magnetic structure 32. For example, in FIG. *2a,* coil 35 is shown to be wound in a counter-clockwise direction about the magnetic pole defined by free end 41, and wound in a clockwise direction about the magnetic pole defined by free end 43. This insures that the currents induced within the coil on vertical portion 37 are in-phase with the currents induced in the coil around free end 41 and in-phase with the currents induced in the coil around free end 43. Additionally, this results in the cancellation of any "hum" induced in the coil by external, spurious signals.

FIG. *2b* illustrates the preferred embodiment of the present invention where a conventional variable reluctance pickup 34 is utilized. There, the variable reluctance pick-up 34 is positioned between the bridge 20 and the magnetic structures 32. As discussed in conjunction with FIG. 1, the output signal from the string transducer portion of the present invention is derived across conductive section 42 and conductive sections 40 and 38. This signal is applied to the primary winding 48 of step-up transformer 36. The output of variable reluctance pickup 34 is supplied for combination with the output from the secondary winding 52 of step-up transformer 36 as shown in FIG. 1.

As can be seen from FIGS. *3a* and *3c*, unlike prior art magnetic pick-ups, the magnetic poles of the present invention are not disposed directly beneath each string. Thus, with respect to hypothetical planes, each of which contains a string and each of which is orthogonal to the string plane, the magnetic poles would be located on either side of these orthogonal planes.

It is further envisioned that the impedance of the coils can be selected to be high or low by appropriate switching and coil tapping. Additionally, the distribution of the magnetic field provided by the present invention permits the magnetic field to be uniquely shaped according to a user's discretion, or to compensate for variations in string characteristics. The physical position of the various magnets can be changed independently and separately from each other and the coil pick-up for fine adjustment of the field shape for unform output.

Means are illustrated in FIG. *3b* by which separate adjustment of each magnet can be achieved. Additionally, it is important to the present invention that vibration of the magnets be prevented, in order to avoid microphonic effects. In the preferred embodiment of the invention, the magnets are inserted into holes 57 provided in body 14 which act to solidly secure the magnets 32 to the instrument body. Mounting screws 53 are used to secure the magnets 32 to the body 14.

The magnetic circuit, with respect to the string current transducer portion of the present invention, can be best appreciated upon reviewing FIG. *3a*. Recall that E string 24 and G string 30 are connected in parallel as are A string 26 and D string 28. All of the strings are electrically connected at the shorting bar 18, but selectively connected at the bridge 20. Due to this configuration, when a string is plucked, for instance the E string 24, the inductive magnetic loop which is formed involves E string 24 and the parallel combination A string 26 and D string 28. Thus, the magnetic poles disposed adjacent E string 24, A string 26 and D string 28 provide the magnetic field which induces the current within the strings.

Experimentation and actual performance trials reveal that the best results for generating current in the strings are achieved by a magnetic field, the effective size of which is no greater than one-eighth the string length. The magnetic fields should be strong enough to induce sufficient current in moving strings to inductively couple to and passively drive a convenient length of cable as is necessary in the normal operation of electric string instruments.

It should be noted that the magnetic field strength can become a source of interference with string motion. In the invention, this problem is overcome by mounting the magnetic field source assembly, preferably no further than one-eighth of the string length from the bridge 20. Greater magnetic force than is present in the preferred embodiment of the invention is required before interference or significant damping of string motion will ocur at this position. An added benefit of this position is a richer harmonic content, i.e., more upper partials than in other positions.

The method of the present invention involves, first of all, positioning and distributing a magnetic field which intersects the string plane so that the magnetic poles are positioned between and adjacent to, as opposed to directly under, the strings and providing adjustment means by which the elevation of the magnets with respect to the strings can be varied as required so that the physical parameters of each string can be compensated for to provide a balanced response for each string. The method also includes the selective connection of certain ones of the strings in the string plane in parallel, and then the series connection of such combination so that the physical differences between each string are equalized. In a specific embodiment of the present invention, the method includes the steps of connecting the E string and G string together and the A string and D string together. The method further includes the steps of providing a step-up transformer which has a very low primary winding impedance and a substantially higher secondary winding impedance.

While the present invention has been discussed with connection with a bass guitar, it is to be understood that the techniques involved are equally applicable to any string instrument where the strings are of magnetically permeable material.

The strings of the instrument need not be constructed totally of magnetically permeable material. The strings can have a nylon or brass wrapping, for example, with a core of permeable metal. The basic requirement of the invention is that the string material have the property that the movement of such material in a magnetic field cause significant perturbation of the magnetic field.

Additionally, it is to be understood that the invention is equally applicable to fretted instruments where such frets are constructed of non-conductive or high resistance materials.

The terms and expressions which have been employed here are used as terms of description, and not of limitation, and there is no intention, in the use of such terms and expressions of excluding of equivalents of the features shown and described, or portions thereof, it being recognized that various modifications are possible within the scope of the invention claimed.

I claim:

1. Apparatus for use in a stringed musical instrument having a plurality of strings generally parallel to one another and lying within a string plane for converting string motion to electrical signals, comprising step-up transformer means having a low impedance primary winding and a substantially higher impedance secondary winding;

a first combination of the strings from the plurality of strings connected in parallel and having a set of equivalent parameters including resistance, mass, permeability, reluctance and inductive reactance;

a second combination of the strings from the plurality of strings connected in parallel and having equivalent parameters including resistance, mass, permeability, reluctance and coercivity, the first and second combination of strings being each extended between a first node and a second node, the first and second combination of strings being electrically connected to one another at the first node so that the first combination is connected in series with the second combination, wherein the series connection of the first and second combinations is electrically connected at the second node across the primary winding of the step-up transformer, and further wherein the equivalent parameters of the first string combination are substantially the same as that for the second string combination; and a plurality of means for supplying a magnetic field, each of which is associated with a different one of the plurality of strings, wherein each magnetic field supplying means include a first magnetic pole and a second opposite magnetic pole, and further wherein each of the magnetic field supplying means is positioned in close proximity to its associated string and so that the first magnetic pole and second magnetic pole thereof are positioned on opposite sides of the associated string.

2. The apparatus of claim 1, wherein each of the magnetic field supplying means is shaped so that the first and second magnetic poles are positioned with respect to one another across a gap and so that the magnetic field supplied between the first and second magnetic poles is concentrated across the gap.

3. The apparatus of claim 2, wherein each magnetic field supplying means comprises a U-shaped magnet.

4. The apparatus of claim 2, wherein each magnetic field supplying means comprise a first post and a second post of magnetically permeable material, and an elongated magnet having a north pole at one end and a south pole at the opposite end, and further wherein one end of the first post is positioned on one end of and perpendicular to the elongated magnet and one end of the second post is positioned on the opposite end of and perpendicular to the elongated magnet to form a U-shaped structure, whereby the free end of the first post provides the first magnetic pole and the free end of the second post provides the second magnetic pole and the free end of the first post is separated from the free end of the second post by a gap, so that the magnetic field is confined to the U-shaped structure and the gap.

5. The apparatus of claim 2, wherein each of the magnetic field supplying means has a U-shaped cross section having first and second upright legs in which the first magnetic pole is located at the top of the first leg and the second magnetic pole is located at the top of the second leg, and further wherein the top of the first and second upright legs are separated by a gap so that the magnetic flux of the magnetic field flows through the U-shaped cross section of the magnetic field supplying means and across the gap between the tops of the first and second upright legs.

6. The apparatus of claim 3, wherein each magnetic field supplying means further includes sensing coil means positioned on each of the magnetic field supplying means for sensing the magnetic flux which flows through each of the magnetic field supplying means and generating an output signal which is representative of the sensed magnetic flux, and means operable by the user for selectively combining the output signal from each sensing coil means with the signal from the secondary winding of the step-up transformer means.

7. The apparatus of claim 6, wherein each of the coil sensing means comprise a multiplicity of turns and further wherein each of the multiplicity of turns is wound coaxially about each of the magnetic field supplying means.

8. The apparatus of claim 1 further including variable reluctance pickup means positioned in relation to the strings for sensing the motion of the strings and for providing a signal which is representative of the sensed string motion, and means for combining the signal from the variable reluctance pickup means with the signal from the secondary winding of the step-up transformer means.

9. The apparatus of claim 6, wherein the combining means comprises means for connecting the sensing coil means to the secondary winding of the step-up transformer means so that movement of the strings within the magnetic field induces a first current flow within the sensing coil means and a second current flow in the series connection of the first and second combination of strings, the second current flow causing a proportional current flow in the secondary winding of the step-up transformer means, whereby a resultant current is produced through the secondary winding and the sensing coil means which is an interactive combination of the first and second current flows, and further wherein the resultant current flow is provided as the output electrical signals.

10. The apparatus of claim 7, wherein the turns of the coil sensing means are wound coaxially about the magnetic field supplying means in a first direction in the vicinity of the first magnetic pole and in a second opposite direction in the vicinity of the second magnetic pole.

11. The apparatus of claim 2, wherein each of the magnetic field supplying means are positioned with respect to its associated string so that the concentrated magnetic field across the gap between the first and second magnetic poles is at right angles to the associated string.

12. The apparatus of claim 1, further including means for individually adjusting the position of each magnetic field supplying means with respect to its associated string.

* * * * *